US009550551B2

(12) United States Patent
Swiatek

(10) Patent No.: US 9,550,551 B2
(45) Date of Patent: Jan. 24, 2017

(54) SURF TAB

(71) Applicant: Ryan Swiatek, Wichita Falls, TX (US)

(72) Inventor: Ryan Swiatek, Wichita Falls, TX (US)

( * ) Notice: Subject to any disclaimer, the term of this patent is extended or adjusted under 35 U.S.C. 154(b) by 0 days.

(21) Appl. No.: 14/757,728

(22) Filed: Dec. 22, 2015

(65) Prior Publication Data

US 2016/0185422 A1 Jun. 30, 2016

Related U.S. Application Data

(60) Provisional application No. 62/095,477, filed on Dec. 22, 2014.

(51) Int. Cl.
*B63B 1/22* (2006.01)
*B63B 35/85* (2006.01)
*B63B 39/06* (2006.01)

(52) U.S. Cl.
CPC ..... *B63B 39/061* (2013.01); *B63B 1/22* (2013.01); *B63B 35/85* (2013.01); *B63B 2035/855* (2013.01)

(58) Field of Classification Search
CPC ..... B63B 1/20; B63B 1/22; B63B 1/26; B63B 1/28; B63B 1/286; B63B 35/85
USPC ..... 114/285
See application file for complete search history.

(56) References Cited

U.S. PATENT DOCUMENTS 3,200,785 A 8/1965 Holger et al.
8,833,286 B1 * 9/2014 Sheedy ..... B63B 1/26 114/285

* cited by examiner

*Primary Examiner* — Lars A Olson
(74) *Attorney, Agent, or Firm* — Shannon L Warren

(57) ABSTRACT

A wake-modifying a surf tab that can be attached to a watercraft is disclosed. That surf tab includes a control plate assembly, a mounting hinge for attaching the control plate assembly to a watercraft, a hydro-thruster assembly, and a separation hinge attaching the control plate assembly to the hydro-thruster assembly. Also included is an actuator attached to the control plate assembly which connects the control plate assembly to the watercraft such that the actuator can control the angle between the control plate assembly and the watercraft. a length adjustable control rod assembly connects the control plate assembly to the hydro-thruster assembly. The control rod assembly adjusts the angle between the control plate assembly and the hydro-thruster assembly. In use, the length of the actuator and the length of the control rod assembly can change the flow of water from the hydro-thruster assembly to modify a wake created by a watercraft.

21 Claims, 14 Drawing Sheets

SURF TAB

CROSS-REFERENCE TO RELATED APPLICATIONS

This application claims the benefit of U.S. Provisional Application No. 62/095,477, which was filed Dec. 22, 2014, the entire disclosures of which are incorporated herein by reference.

STATEMENT REGARDING FEDERALLY SPONSORED RESEARCH OR DEVELOPMENT (IF APPLICABLE)

Not applicable.

REFERENCE TO SEQUENCE LISTING, a TABLE, OR a COMPUTER PROGRAM LISTING COMPACT DISC APPENDIX (IF APPLICABLE)

Not applicable.

BACKGROUND OF THE INVENTION

This disclosure relates generally to a Surf Tab. Examples of surf tabs can be found at U.S. Pat. No. 8,833,286, U.S. Pat. No. 8,578,873, U.S. Pat. No. 8,534,214, U.S. Pat. No. 8,539,897, U.S. Pat. No. 6,941,884, U.S. Pat. No. 4,577,580, U.S. Pat. No. 3,200,785, U.S. Ser. No. 14/626,249, U.S. Pat. No. 9,174,703, and U.S. Pat. No. 9,067,644. None of the known inventions and patents, taken either singularly or in combination, is seen to describe the instant disclosure as claimed. Accordingly, an improved Surf Tab would be advantageous.

BRIEF SUMMARY OF THE INVENTION

Very few if any leisure activities are more enjoyable than boating. Recreational boating on a lake, the ocean, a river, a canal or any other waterways can be a very pleasant way to spend leisure time.

One (1) way to enhance the joy of boating even more is to add other activities to boating. From fishing to diving a boat can be used for many purposes. But one particularly enjoyable activity associated with various watercrafts is water skiing or water surfing. However, when performing some surfing maneuvers it can be useful to weigh down the side of the watercraft where the water skier is positioned. The additional weight modifies the boat wake which can protect the water skier as well as enabling them to perform acrobatics using the modified watercraft wake. In fact, the wake of a watercraft becomes a highly useful factor when water skiing.

Because of the usefulness of watercraft wakes various manufacturers have devised wake modifying devices which can be attached to the aft of a watercraft to provide modified wakes. These devices can eliminate the need to shift weight along the sides of the watercraft. While some of those devices are useful there has been seen a need to provide devices that enabling a water skier to ski on either side of the watercraft. Wake modifying devices that do exist tend to be large and bulky, generally do not provide a clean wake, and/or are inefficient in regards to watercraft fuel consumption.

Accordingly, there exists a need for a device that can modify watercraft wakes on both sides of a watercraft so as to provide a clean wake while not being unduly large or bulky and while providing improved fuel efficiency.

FIELD OF THE INVENTION

The presently disclosed subject matter is directed to recreational watercrafts. More particularly, it is directed to wake-modifying surf tabs that can be mounted on a recreational or other watercraft to enhance water skiing.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DETAILED DESCRIPTION OF THE INVENTION

Described herein is a Surf Tab. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

The terms "a" and "an" as used herein do not denote a limitation of quantity, but rather denote the presence of at least one (1) of the referenced items.

The principles of the present invention provide for improved watercraft wake modifying devices that provide a clean wake while not being unduly large or bulky and while providing improved fuel efficiency when compared to other wake modifying devices.

Figure 1A:
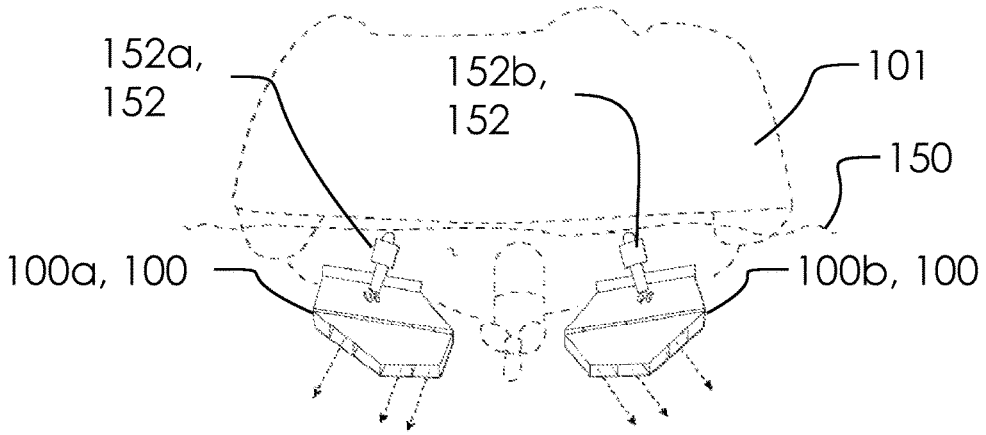
FIG. 1A illustrates elevated rear view of a watercraft 101 with a one or more surf tabs 100.

FIG. 1A illustrates elevated rear view of a watercraft 101 with a one or more surf tabs 100.

Illustrated herein are an one or more surf tabs 100, a starboard surf tab 100*a*, a port surf tab 100*b*, a watercraft 101, a control plate assembly 102, a main control plate 104, an one or more separation fins 106, a first separation fin 106*a*, a second separation fin 106*b*, a mounting hinge 108, a first portion 108*a*, a second portion 108*b*, a separation hinge 110, a hydro-thruster assembly 116, an upper hydro-thruster plate 118, a lower hydro-thruster plate 120, a side hydro-thruster plate 122, an one or more diversion fins 124, a first diversion fin 124*a*, a second diversion fin 124*b*, a third diversion fin 124*c*, a fourth diversion fin 124*d*, a control rod assembly 126, a first end 126*a*, a second end 126*b*, a control rod 126*c*, an one or more mounting brackets 128, a first mounting bracket 128*a*, a second mounting bracket 128*b*, an mounting bracket 130, a water surface 150, an one or more actuators 152, a first actuator 152*a*, a second actuator 152*b*. In one embodiment, said control rod 126*c* can comprise a variable length, which can be created with an adjustable turnbuckle-style rod.

In one embodiment, said one or more surf tabs 100 can comprise said starboard surf tab 100*a*, said port surf tab 100*b*, said control plate assembly 102, said mounting hinge 108, said separation hinge 110, said hydro-thruster assembly 116, said fasteners 220, said control rod assembly 126, said one or more mounting brackets 128, said mounting bracket 130, and said one or more actuators 152.

The one or more surf tabs 100 and the starboard surf tab 100*a* are mirror-images of one another. Thus discussing and describing the port surf tab 100*b* suffices as a discussion and description of the starboard surf tab 100*a*. However, to aid understanding starboard surf tab 100*a* is discussed in a manner to enhance the understanding of the mirror-image relationships. It should be understood however that the watercraft 101 does not need to be equipped with both a port surf tab 100*b* and a starboard surf tab 100*a*. While using both can provide highly beneficial wakes, one (1) or the other can also produce useful wakes. Locating a surf tab on one side will produce a modified wake along that side, while having surf tabs on both sides can produce rather dramatic wake effects across the aft of the watercraft 101.

Figure 1B:
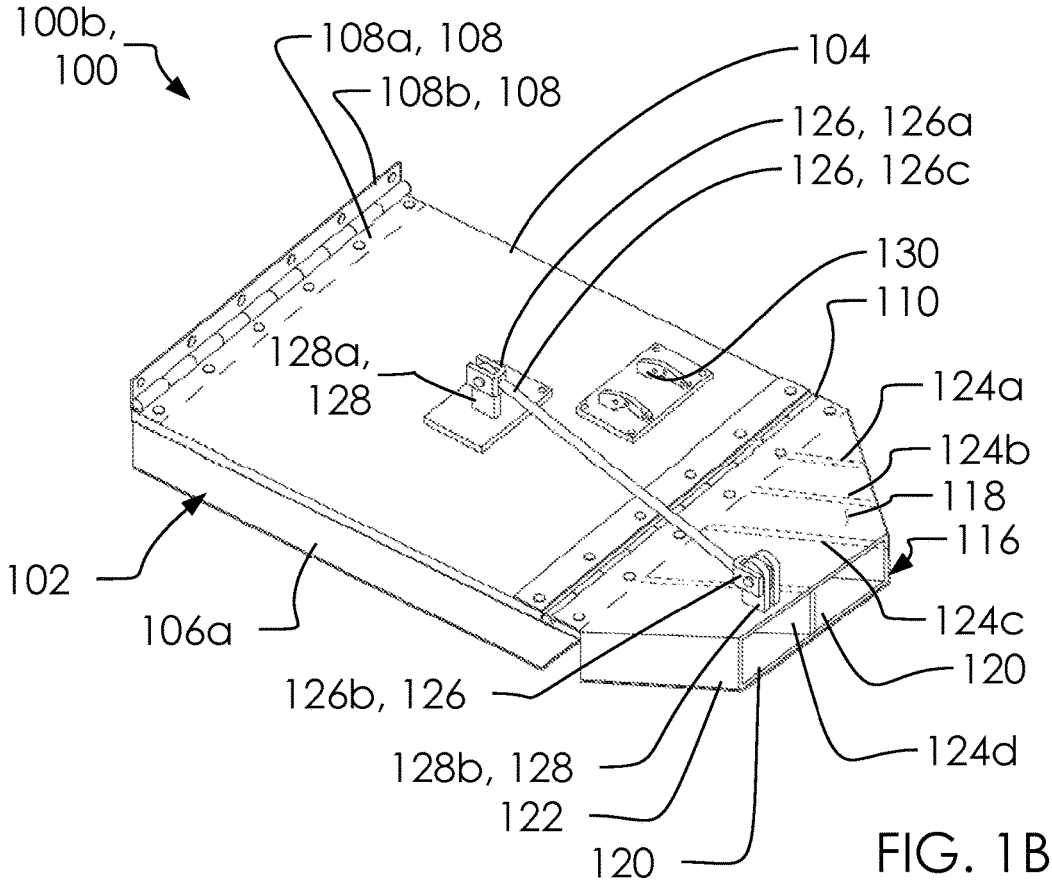
FIG. 1B illustrates perspective overview of a port surf tab 100*b*.

FIG. 1B illustrates perspective overview of a port surf tab 100*b*.

In one embodiment, said one or more surf tabs 100 can shape a wake behind said watercraft 101, as is known in the art. In one embodiment, said starboard surf tab 100*a* can be attached to a port side of said watercraft 101 and said port surf tab 100*b* can be attached to a starboard side of said watercraft 101. In one embodiment, said one or more surf tabs 100 can each comprise said control plate assembly 102 and said hydro-thruster assembly 116, which can be adjustably rotated to one another on said mounting hinge 108 and/or said separation hinge 110. In one embodiment, said control plate assembly 102 can be rotateably attached to said watercraft 101 with said mounting hinge 108 and said hydro-thruster assembly 116 can be rotateably attached to said control plate assembly 102 with said separation hinge 110.

In one embodiment, said control rod assembly 126 can comprise an adjustable length which can be set so as to hold said hydro-thruster assembly 116 and a selected angle relative to said control plate assembly 102.

In one embodiment, said one or more mounting brackets 128 can attach said control rod assembly 126 to said control plate assembly 102 and said hydro-thruster assembly 116, as illustrated. For example, in one embodiment, said first mounting bracket 128*a* can attach said first end 126*a* to said control plate assembly 102, and said second mounting bracket 128*b* can attach said second end 126*b* to said hydro-thruster assembly 116.

In one embodiment, said mounting bracket 130 can adjustably receive one among said one or more actuators 152, as illustrated. Thus, an angle between said control plate assembly 102 and said watercraft 101 can be adjusted with said one or more actuators 152 and an angle between said control plate assembly 102 and said hydro-thruster assembly 116 can be adjusted with said control rod assembly 126.

The one or more surf tabs 100 includes the control plate assembly 102 which has a heavy-duty piano-type hinges, said mounting hinge 108, that can be used to attach the one or more surf tabs 100 to the watercraft 101. The control plate assembly 102 also includes a heavy-duty piano-type hinge, said separation hinge 110, which can be located on an end opposite the mounting hinge 108. The separation hinge 110 couples the control plate assembly 102 to the hydro-thruster assembly 116. The control plate assembly 102 and the hydro-thruster assembly 116 are also connected by a control rod assembly 126 disposed between said one or more mounting brackets 128. The first mounting bracket 128*a* can be rigidly attached to the control plate assembly 102, the second mounting bracket 128*b* can be rigidly attached to the hydro-thruster assembly 116, and the control rod assembly 126 can be attached said one or more mounting brackets 128. The control rod assembly 126 can be envisioned as being an adjustable turnbuckle-style device which allows finite angular adjustment of the hydro-thruster assembly 116 to effect wake shape and size.

In one embodiment, said control plate assembly 102 can be beneficially made from welded sections of three-sixteenth (3/16 in.) thick aluminum plate.

As previously noted the hydro-thruster assembly 116 can be attached to the main control plate 104 via the separation hinge 110. The separation hinge 110 can be envisioned as being a piano-type hinge extending across the full width of the main control plate 104 and as allowing the hydro-thruster assembly 116 to pivot.

In one embodiment, said one or more actuators 152 can be operable to be electrically controlled to raise and lower said one or more surf tabs 100 on said mounting hinge 108.

Figure 2:
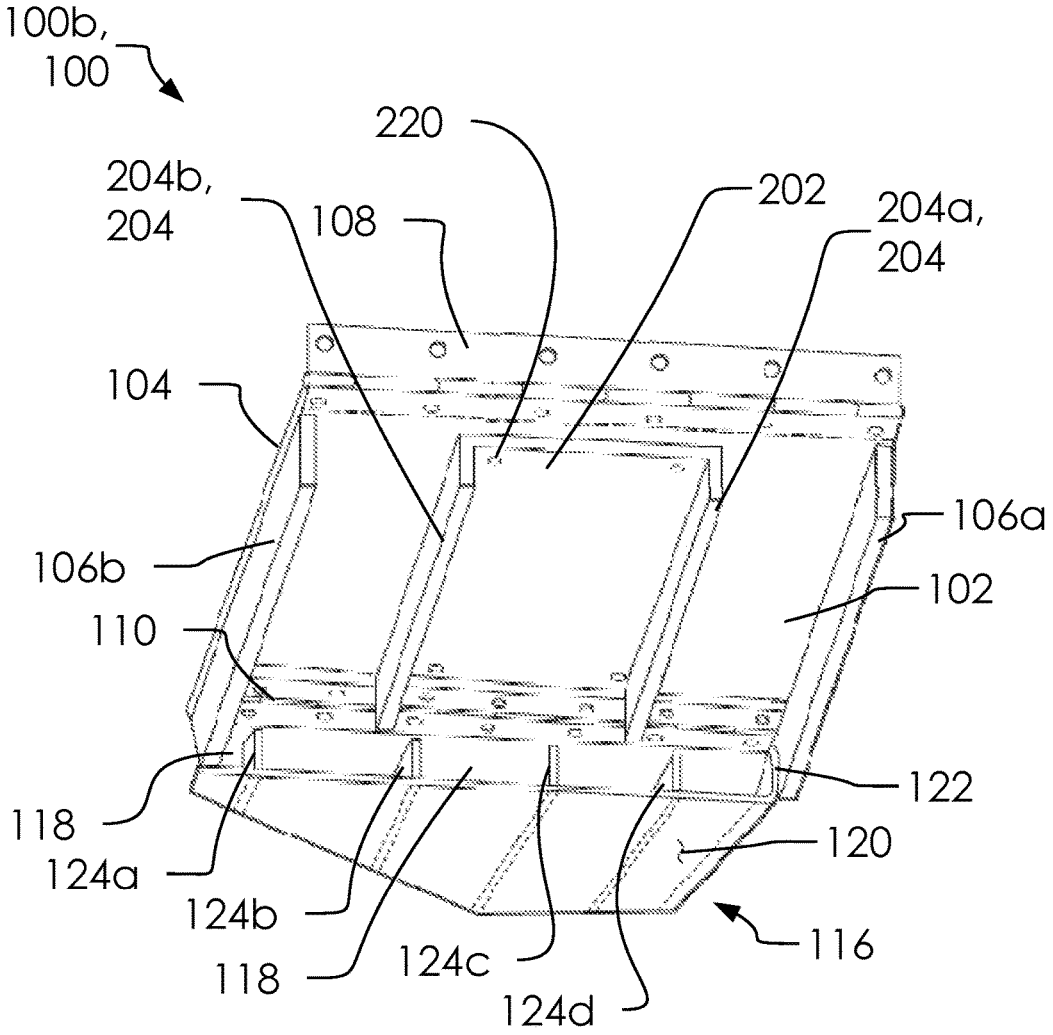
FIG. 2 illustrates perspective lower view of a port surf tab 100*b*.

FIG. 2 illustrates perspective lower view of a port surf tab 100*b*.

Illustrated herein are an intermediate fin plate 202, a one or more setup fins 204, a first setup fin 204*a*, a second setup fin 204*b*, a fasteners 220.

In one embodiment, said intermediate fin plate 202 can comprise said one or more setup fins 204. In one embodiment, said one or more setup fins 204 can comprise said first setup fin 204*a*, said second setup fin 204*b*.

The control plate assembly 102 can comprise said main control plate 104 having sides comprised of said one or more separation fins 106 being downwardly extending fins. In one embodiment, said one or more separation fins 106 can comprise said first separation fin 106*a* and said second separation fin 106*b*.

Additionally, said control plate assembly 102 can comprise said intermediate fin plate 202 comprising a "U"-shaped cross-section. In one embodiment, said intermediate fin plate 202 can be affixed to the lower surface of the main control plate 104 between the first separation fin 106*a* and the second separation fin 106*b* via said fasteners 220. The intermediate fin plate 112 has a first setup fin 204*a* and a parallel fin, said second setup fin 204*b*, which extend perpendicularly downward.

The main control plate 104 does the majority of the work in diverting water to create voids or area of low pressure behind the watercraft 101 as the watercraft travels through the water. The angle of the main control plate 104 relative to the hull of the watercraft 101 as controlled by the one or more actuators 152 controls the overall effect. a downward angle of 100 degrees or so can provide rather dramatic effects. The main control plate 104 provides a large area that can change water flow over a rather long distance and can be adjusted to improve efficiency and reduce drag and cavitation as desired.

In one embodiment, said first separation fin 106*a* is mounted on an inward side of said one or more surf tabs 100 (with reference to a space between said one or more surf tabs 100 as mounted to said watercraft 101). In one embodiment, said first separation fin 106*a* separates water coming off the hull from the water disturbed by the propeller 404. This beneficially results in the water trapped by the main control plate 104 being free of bubbles.

In one embodiment, said second separation fin 106*b* is shorter but also extends along the length of the main control plate 104. In one embodiment, said second separation fin 106*b* lets a small amount of water flow under the main control plate 104 from outside of the watercraft 101. This creates a higher pressure under the one or more surf tabs 100 and thus a lower pressure behind the one or more surf tabs 100 while also providing structural integrity to the main control plate 104.

Said one or more surf tabs 100 as illustrated in FIGS. 1B and 2 comprises said one or more separation fins 106 as covering a full distance between said mounting hinge 108 and said separation hinge 110; however, in another embodiment, said one or more separation fins 106 can be designed and updated according to another specification. Accordingly, FIG. 6 (and following) are included to show a different design for said one or more separation fins 106. More discussion is directed toward this design to come.

In one embodiment, said one or more setup fins 204 can comprise different lengths. For example, in one embodiment, said first setup fin 204*a* is the longer than said second setup fin 204*b*, which run parallel to one (1) another. In one embodiment, said first setup fin 204*a* extends downward and runs the entire length of the main control plate 104. In one embodiment, said second setup fin 204*b* is the shorter of the two (2) setup fins and it also extends downward and runs the entire length of the main control plate 104. Both of said one or more setup fins 204 add to the structural integrity of the one or more surf tabs 100. In one embodiment, said one or more setup fins 204 also help set up the flow of water into an upper hydro-thruster plate 118 of the hydro-thruster assembly 116.

In one embodiment, said one or more separation fins 106 comprise portions of said main control plate 104 turned downward. In another embodiment, said one or more separation fins 106 can comprise plates welded to said main control plate 104, as is known in the art.

In one embodiment, portions of said one or more surf tabs 100 can comprise welded aluminum.

Figure 3A:
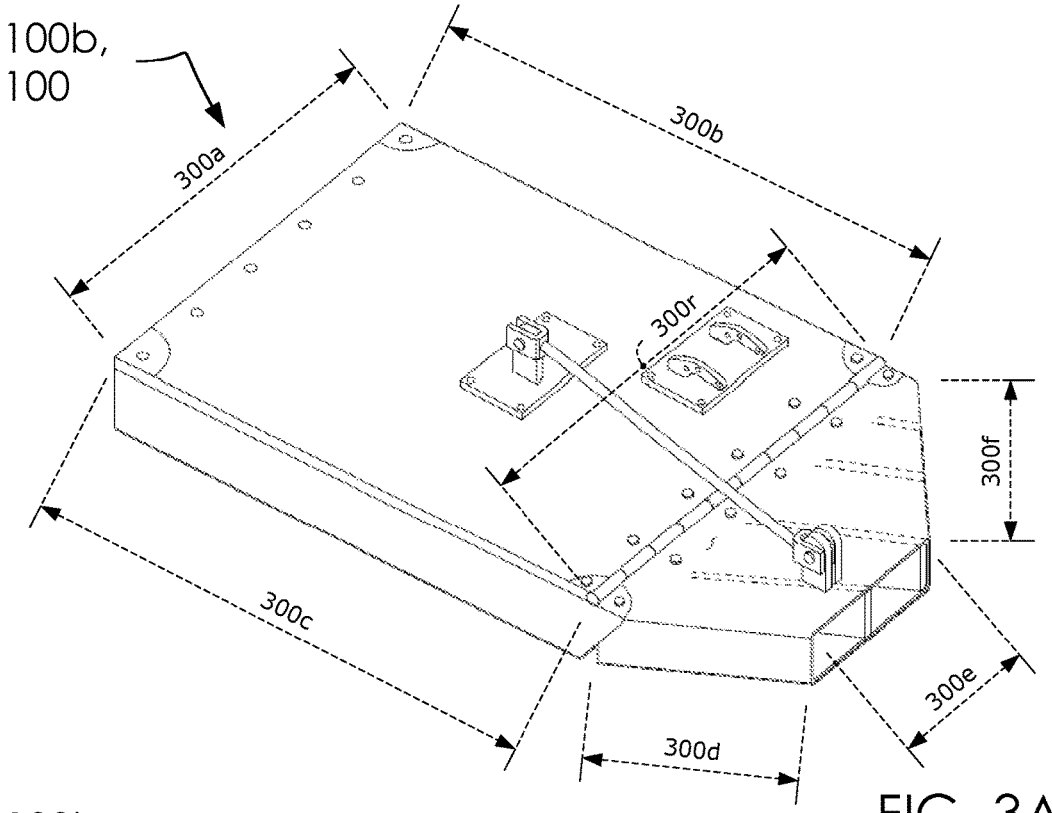
FIGS. 3A and 3B illustrate two perspective overviews of a port surf tab 100*b*.
Figure 3B:
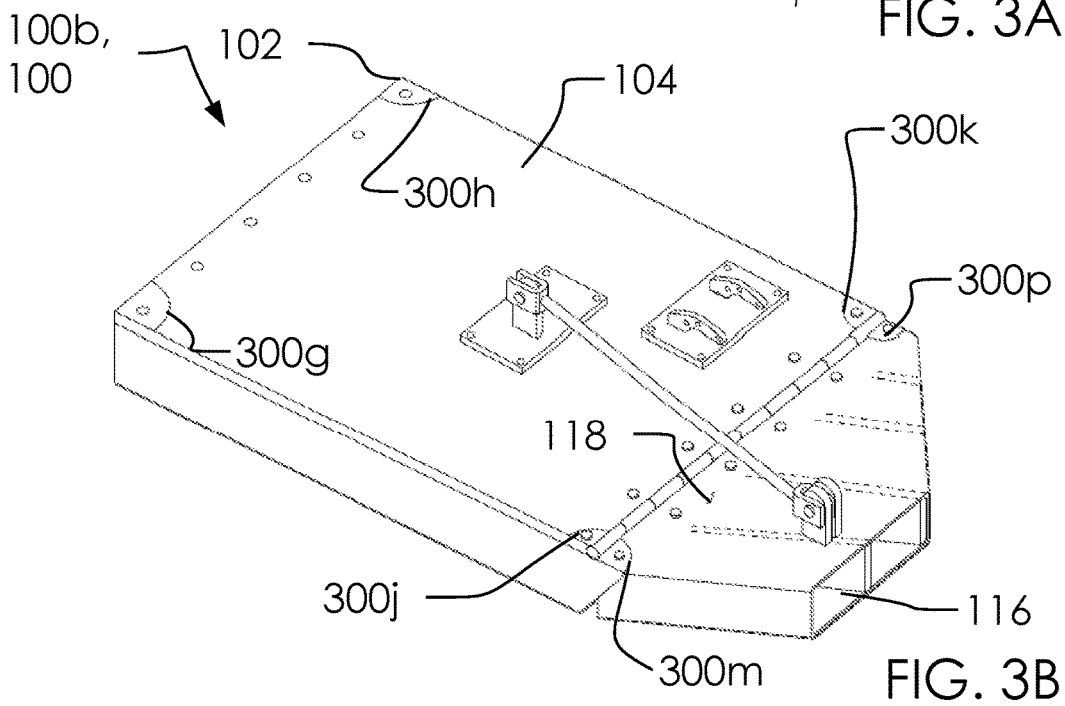

FIGS. 3A and 3B illustrate two perspective overviews of a port surf tab 100*b*.

Illustrated herein are a dimension a 300*a*, a dimension b 300*b*, a dimension c 300*c*, a dimension d 300*d*, a dimension e 300*e*, a dimension f 300*f*, an angle g 300*g*, an angle h 300*h*, an angle j 300*j*, an angle k 300*k*, an angle m 300*m*, an angle n 300*n*, an angle p 300*p*, an angle q 300*q*, a dimension r 300*r*.

In one embodiment, said one or more surf tabs 100 can comprise a variation on dimensions, as would be obvious to one in the art. However, one suggested embodiment comprises said dimension a 300*a* as being 17% inches, said angle h 300*h* being 99 degrees, and said angle g 300*g* being 81 degrees. However, variations on these dimensions would result in similar performance and output from said one or more surf tabs 100. In one embodiment, the arrangement of said hydro-thruster assembly 116 behind said watercraft 101 can comprise a primary goal accomplished through a variety of variations on said one or more surf tabs 100. One suggested embodiment can be found in the provisional application to which this applications claims benefit.

Figure 4:
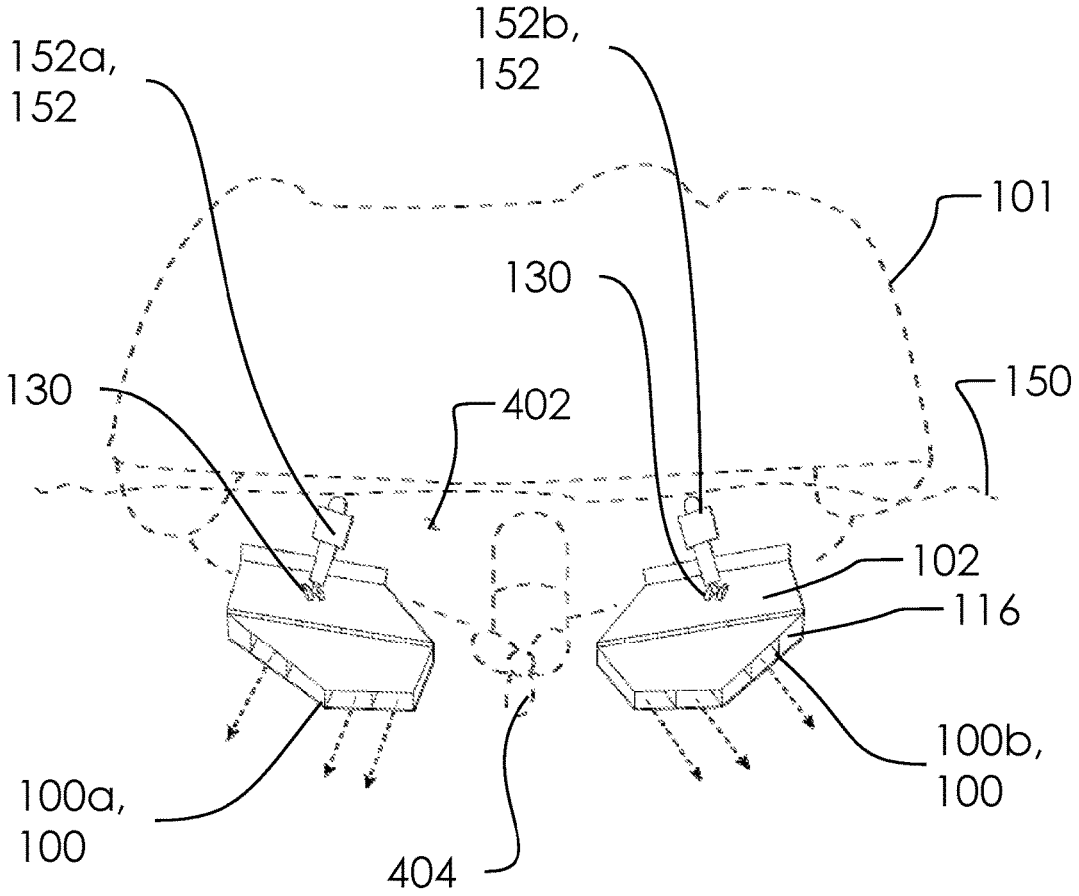
FIG. 4 illustrates elevated rear view of a watercraft 101 with said one or more surf tabs 100.

FIG. 4 illustrates elevated rear view of a watercraft 101 with said one or more surf tabs 100.

Illustrated herein are a transom 402, and a propeller 404.

In one embodiment, said one or more surf tabs 100 can be installed onto said watercraft 101 as illustrated.

The one or more surf tabs 100 and the starboard surf tab 100*a* are mounted to the transom 402 of the watercraft 101 on respective sides of a propeller 404. In one embodiment, said one or more surf tabs 100 and the starboard surf tab 100*a* are designed to descend at a user-controlled angle below the water surface 150 so as to modify the wake created by the watercraft 101 as it moves over a water surface 150.

In one embodiment, the hydrodynamic effects of the control plate assembly 102 and the hydro-thruster assembly 116 are adjustable by an electric linear embodiment of said one or more actuators 152. In one embodiment, said one or more actuators 152 allows a user to raise and lower the one or more surf tabs 100.

In one embodiment, said one or more actuators 152 is attached at one (1) end to the watercraft 101 and at the other end to mounting brackets 130 which can be rigidly attached to the top of the control plate assembly 102. In one embodiment, said positions of the control rod assembly 126 and the one or more actuators 152 adjust water flow through the one or more surf tabs 100 when the watercraft 460 moves through the water so as to modify the wake created by the watercraft 101. Redirecting the flow of water between the control plate assembly 102 and the hydro-thruster assembly 116 provides lift to the stern of the watercraft 101. Thus, in one embodiment, a fuel savings is anticipated as the one or more surf tabs 100 allows the watercraft 101 to run flat and level across the water surface 150, allowing the propeller 404 to be more efficient.

The angular positioning of the one or more surf tabs 100 is accomplished via the one or more actuators 152, which is envisioned to be an electric cylinder-type device. In one embodiment, said one or more actuators 152 is envisioned to be similar to those manufactured by LENCO MARINE CO™ and other companies. As such it is envisioned as being controlled using a corresponding control module that is conveniently located so that an operator of the watercraft 101 can make adjustments.

The main control plate 104 does the majority of the work as far as diverting water by creating a void or area of low pressure behind it as the watercraft 101 travels forward. In one embodiment, said angle of the main control plate 104 relative to the hull of the watercraft 101 is important as it also diverts water outward at approximately ten degrees (10°) from the center of the watercraft 101. In one embodiment, said main control plate 104 provides a large area to change the flow of water over a longer distance, thereby improving efficiency, thereby reducing drag and cavitation.

As previously noted the one or more surf tabs 100 may include both starboard and port control plate assemblies and hydro-thruster assemblies. Those assemblies can work together to produce dynamic hydrodynamic effects. 454.

Figure 5A:
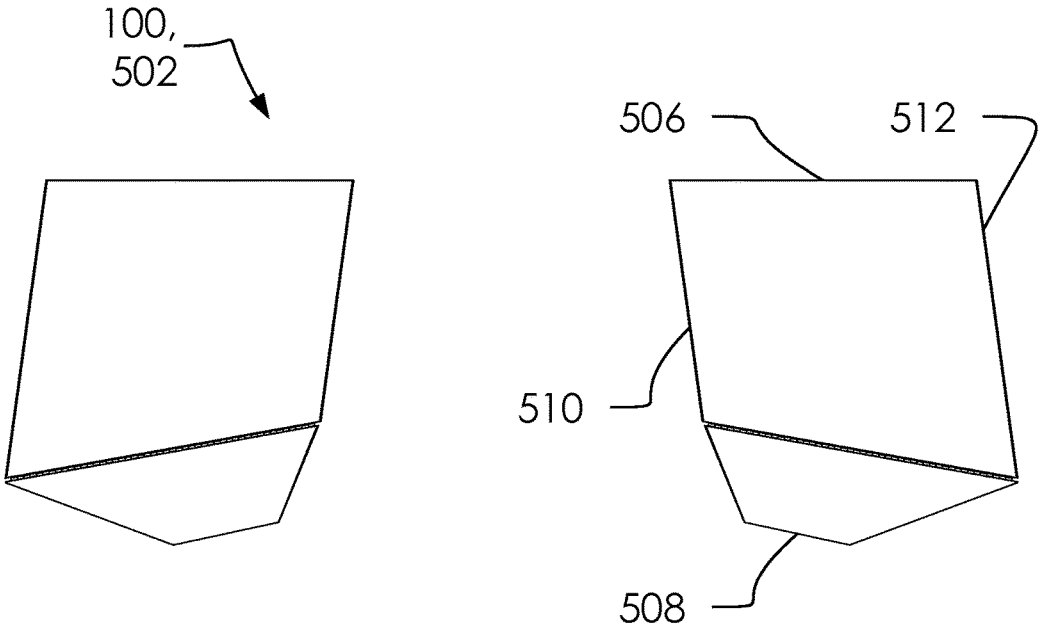
FIG. 5A illustrates elevated top view of a one or more surf tabs 100 in a non-engaged position 502.
Figure 5B:
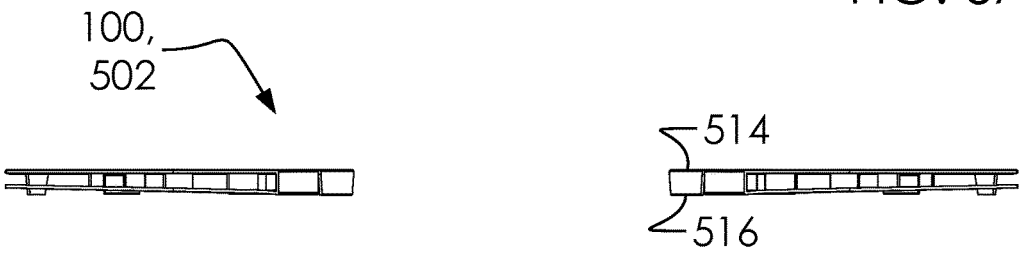
FIG. 5B illustrates elevated front view of a one or more surf tabs 100 in a non-engaged position 502.
Figure 5C:
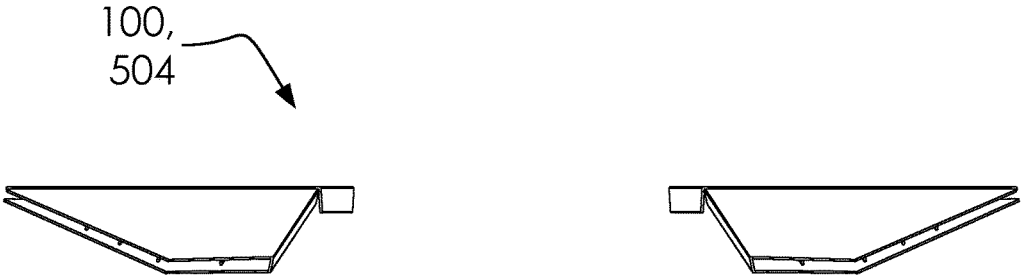
FIG. 5C illustrates elevated front view of a one or more surf tabs 100 in an engaged position 504.

FIG. 5A illustrates elevated top view of a one or more surf tabs 100 in a non-engaged position 502. FIG. 5B illustrates elevated front view of a one or more surf tabs 100 in a non-engaged position 502. FIG. 5C illustrates elevated front view of a one or more surf tabs 100 in an engaged position 504.

Illustrated herein are a non-engaged position 502, an engaged position 504.

As illustrated in FIG. 5A and following, said one or more surf tabs 100 will comprise only said control plate assembly 102, said intermediate fin plate 202 and said hydro-thruster assembly 116. The remaining parts from FIGS. 1B and 2, for example, remain a part of the preferred embodiment; however, FIG. 5A and following are included to show a more preferred approach to the design of said 102 and said hydro-thruster assembly 116.

In one embodiment, said hydro-thruster assembly 116 can be selectively rotated between said non-engaged position 502, said engaged position 504, as illustrated.

In one embodiment, each among said one or more surf tabs 100 can comprise a leading edge 506, a trailing edge 508, an interior side 510, an exterior side 512, a top side 514 and a bottom side 516.

Figure 6A:
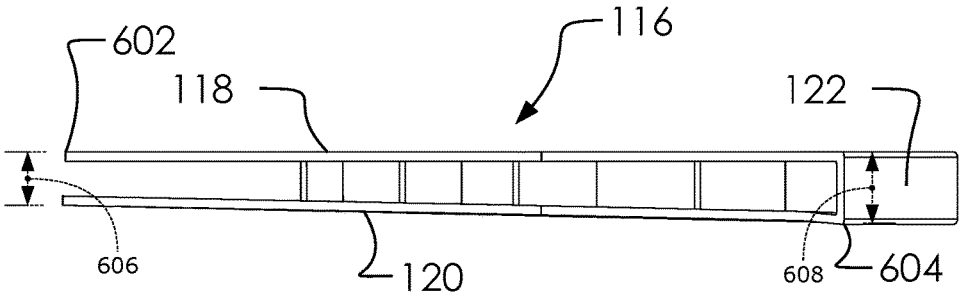
FIG. 6A illustrates elevated front view of a hydro-thruster assembly 116.
Figure 6B:
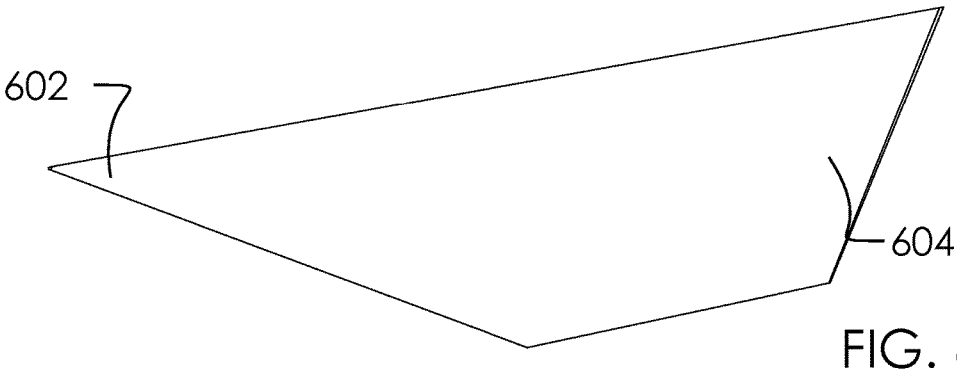
FIG. 6B illustrates elevated top view of a hydro-thruster assembly 116.
Figure 6C:
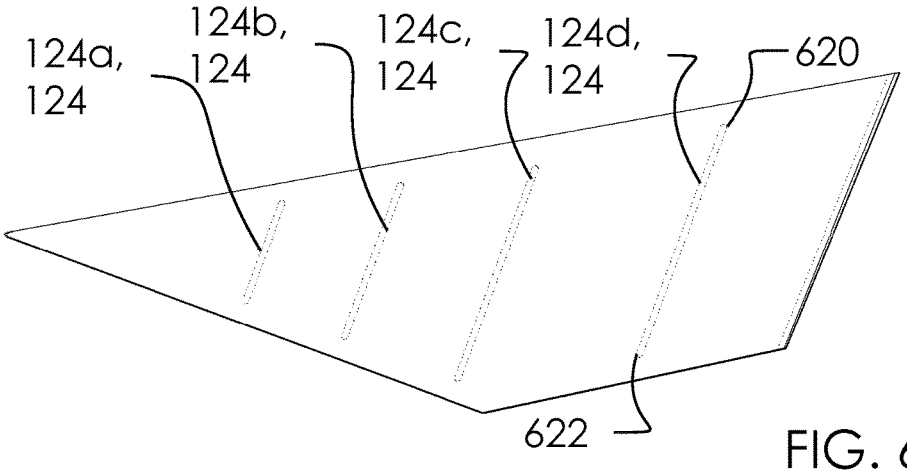
FIG. 6C illustrates elevated top view with back edges shown in dashed lines of a hydro-thruster assembly 116.

FIG. 6A illustrates elevated front view of a hydro-thruster assembly 116. FIG. 6B illustrates elevated top view of a hydro-thruster assembly 116. FIG. 6C illustrates elevated top view with back edges shown in dashed lines of a hydro-thruster assembly 116.

Illustrated herein are a first side 602, a second side 604, a first height 606, and a second height 608.

In one embodiment, said first height 606 is smaller than said second side 604; thereby, said hydro-thruster assembly 116 can comprise a wedge shape with said side hydro-thruster plate 122 at said interior side 510 being larger than said first side 602.

In one embodiment, said hydro-thruster assembly 116 can comprise said upper hydro-thruster plate 118, a lower hydro-thruster plate 120, a side hydro-thruster plate 122, and said one or more diversion fins 124. In one embodiment, said upper hydro-thruster plate 118 is attached to the main control plate 104 via the separation hinge 110. In one embodiment, said upper hydro-thruster plate 118 acts as a platform for attachment of an adjustable rod; namely, said control rod assembly 126. In one embodiment, said lower hydro-thruster plate is mounted on the bottom of the hydro-thruster assembly 116 and provides diversion of water downward and towards the outside of the watercraft 101. In one embodiment, said lower hydro-thruster plate 120 and the upper hydro-thruster plate 118 hold said one or more diversion fins 124 in place.

In one embodiment, said hydro-thruster assembly 116 can receive a portion of incoming water from said main control plate 104. That water is then re-routed and forced out between said upper hydro-thruster plate 118, said lower hydro-thruster plate 120, said side hydro-thruster plate 122 and said one or more diversion fins 124, and thereby allowing control of the water as it leaves the one or more surf tabs 100. In one embodiment, said hydro-thruster assembly 116 can also be fine-tuned, so as to compliment a particular hull design of the watercraft 101.

The lower hydro-thruster plate 120, mounted on the bottom of the hydro-thruster assembly 116, can divert water downward and towards the outside of the watercraft 101. In one embodiment, said one or more diversion fins 124 can divert water outward away from the propeller 404. In one embodiment, said one or more diversion fins 124 can comprise decrementing lengths that match the upper hydro-thruster plate 118.

In one embodiment, said one or more diversion fins 124 are arranged with a leading fin edge 620 being proximate to said second side 604 and a trailing fin edge 622 arranged proximate to said first side 602. In one embodiment, said one or more diversion fins 124, therefore, direct fluid rearward and outward relative to the motion of said watercraft 101 and said one or more surf tabs 100.

Figure 7A:
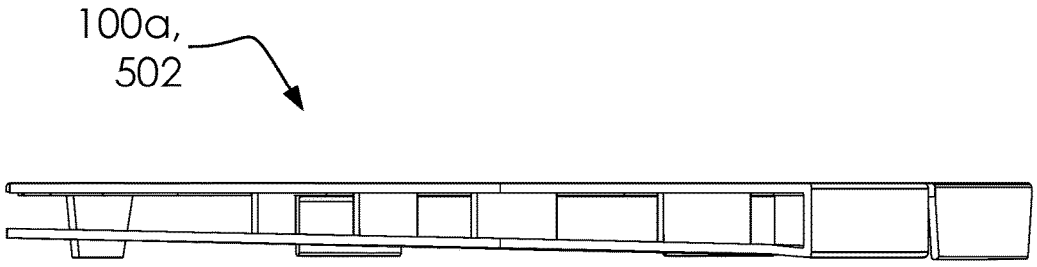
FIG. 7A illustrates elevated front view of a starboard surf tab 100*a* in a non-engaged position 502.
Figure 7B:
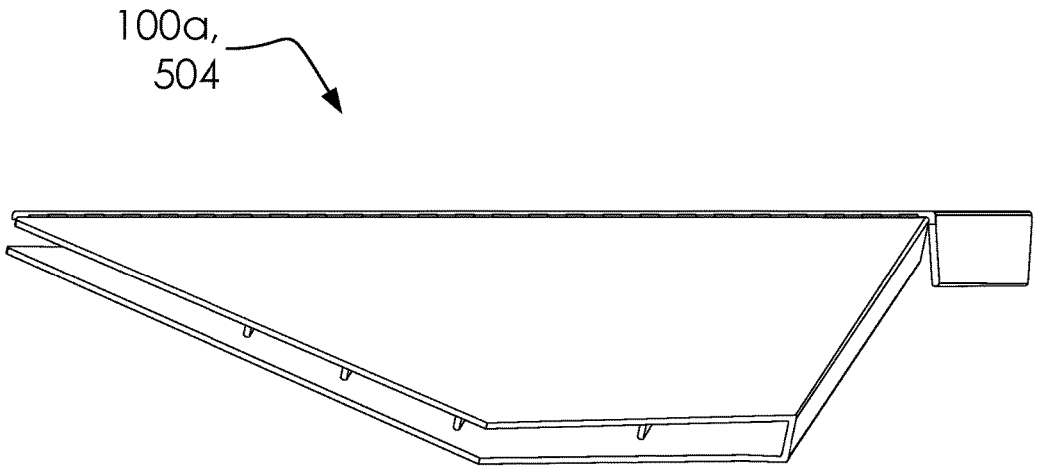
FIG. 7B illustrates elevated front view of a starboard surf tab 100*a* in an engaged position 504.

FIG. 7A illustrates elevated front view of a starboard surf tab 100*a* in a non-engaged position 502. FIG. 7B illustrates elevated front view of a starboard surf tab 100*a* in an engaged position 504.

Figure 8A:
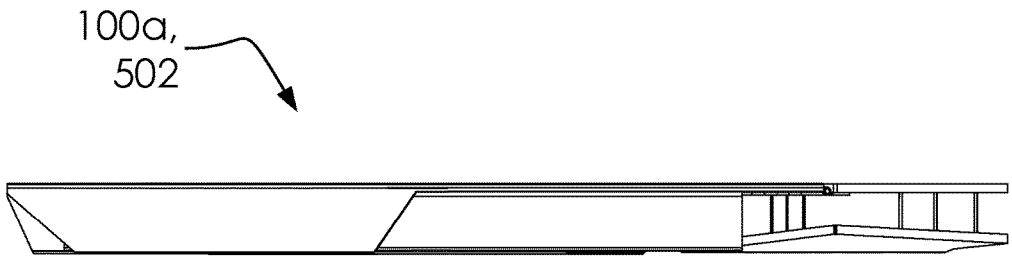
FIG. 8A illustrates elevated side view of a starboard surf tab 100*a* in a non-engaged position 502.
Figure 8B:
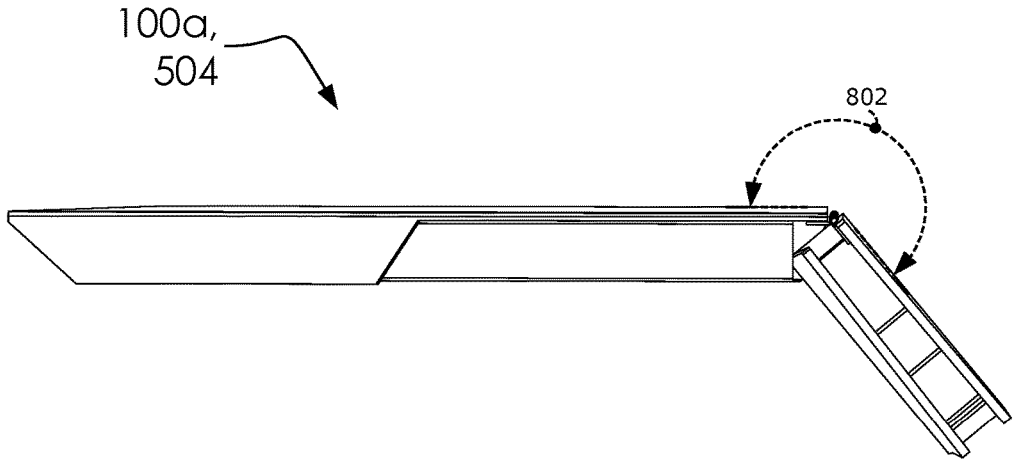
FIG. 8B illustrates elevated side view of a starboard surf tab 100*a* in an engaged position 504.

FIG. 8A illustrates elevated side view of a starboard surf tab 100*a* in a non-engaged position 502. FIG. 8B illustrates elevated side view of a starboard surf tab 100*a* in an engaged position 504.

In one embodiment, said control plate assembly 102 and said hydro-thruster assembly 116 can comprise a hydro-thruster angle 802, as illustrated.

Figure 9A:
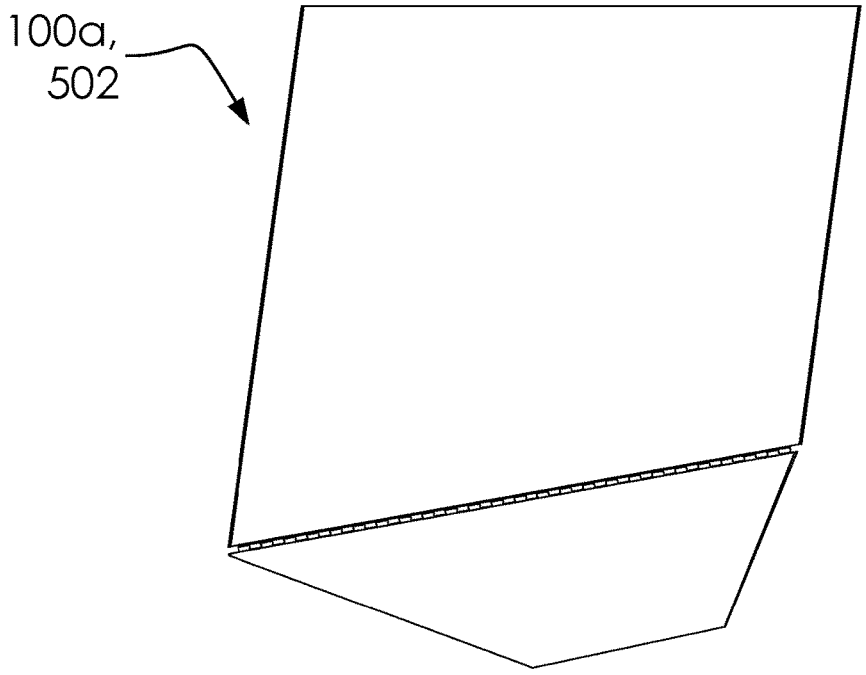
FIG. 9A illustrates elevated top view of a starboard surf tab 100*a*.
Figure 9B:
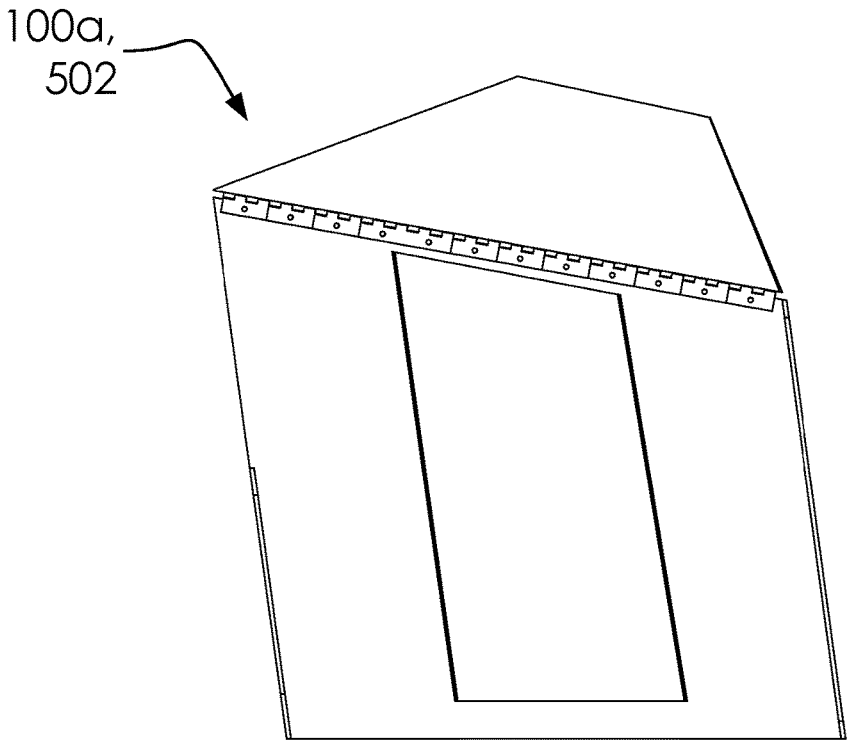
FIG. 9B illustrates elevated backside view of a starboard surf tab 100*a*.

FIG. 9A illustrates elevated top view of a starboard surf tab 100*a*. FIG. 9B illustrates elevated backside view of a starboard surf tab 100*a*.

Figure 10:
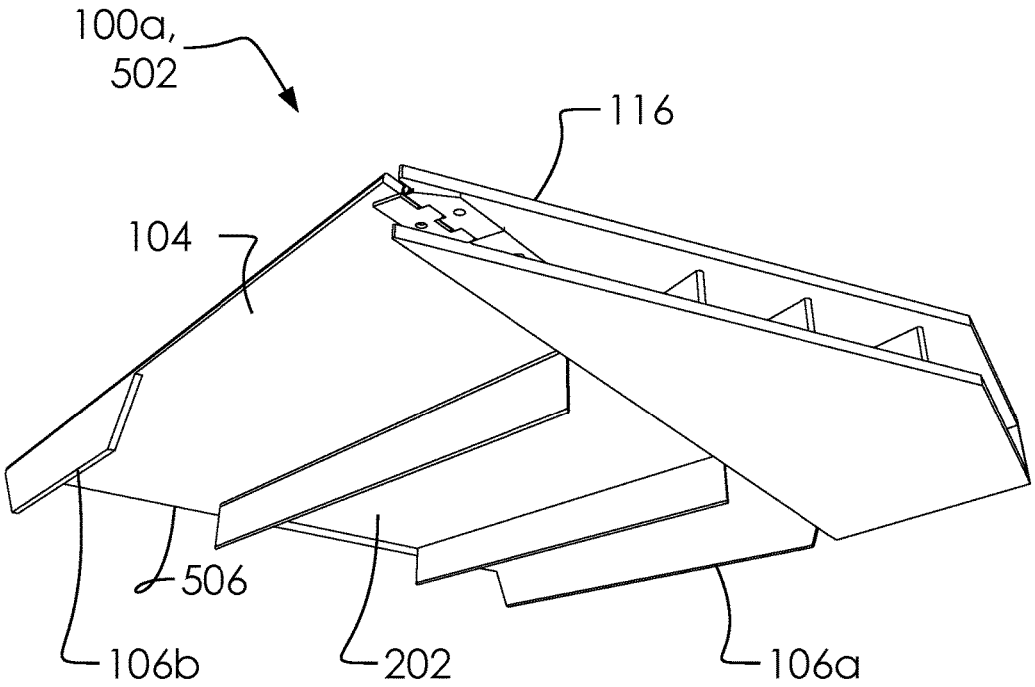
FIG. 10 illustrates perspective lower view of a starboard surf tab 100*a*.

FIG. 10 illustrates perspective lower view of a starboard surf tab 100*a*.

In one embodiment, said second separation fin 106*b* can be isolated in a portion of said control plate assembly 102 corresponding to said leading edge 506. That is, said second separation fin 106*b* can be half the length of said control plate assembly and located at or near said leading edge 506.

In one embodiment, said one or more separation fins 106 are substantially parallel with one another. That is, said one or more separation fins 106 each comprise a plane being parallel with the other.

Figure 11A:
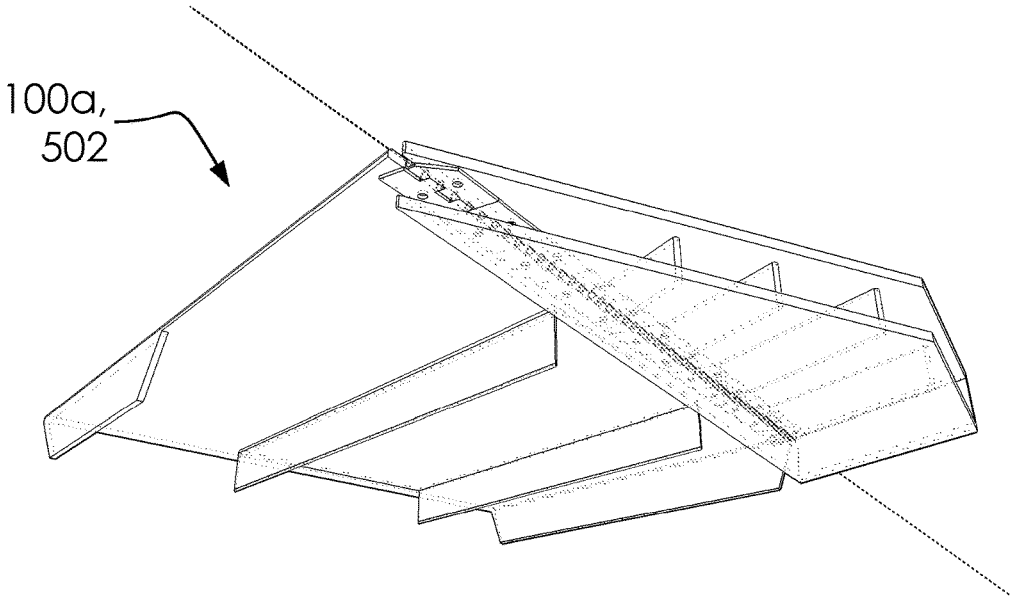
FIG. 11A illustrates perspective lower view of a starboard surf tab 100*a* with back edges shown in dashed lines.
Figure 11B:
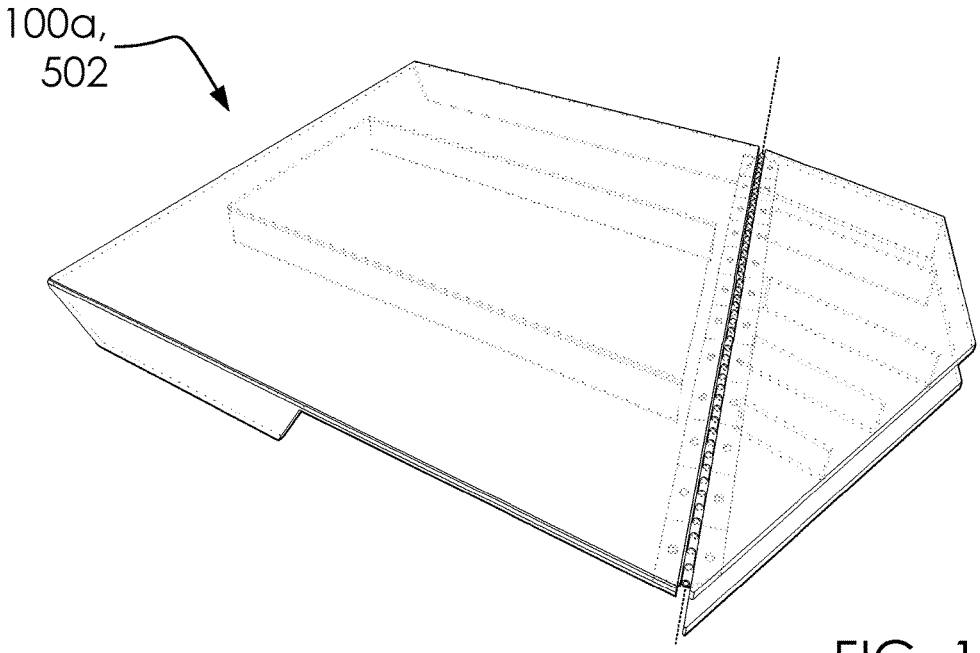
FIG. 11B illustrates perspective overview of a starboard surf tab 100*a* with back edges shown in dashed lines.

FIG. 11A illustrates perspective lower view of a starboard surf tab 100*a* with back edges shown in dashed lines. FIG. 11B illustrates perspective overview of a starboard surf tab 100*a* with back edges shown in dashed lines.

Figure 12:
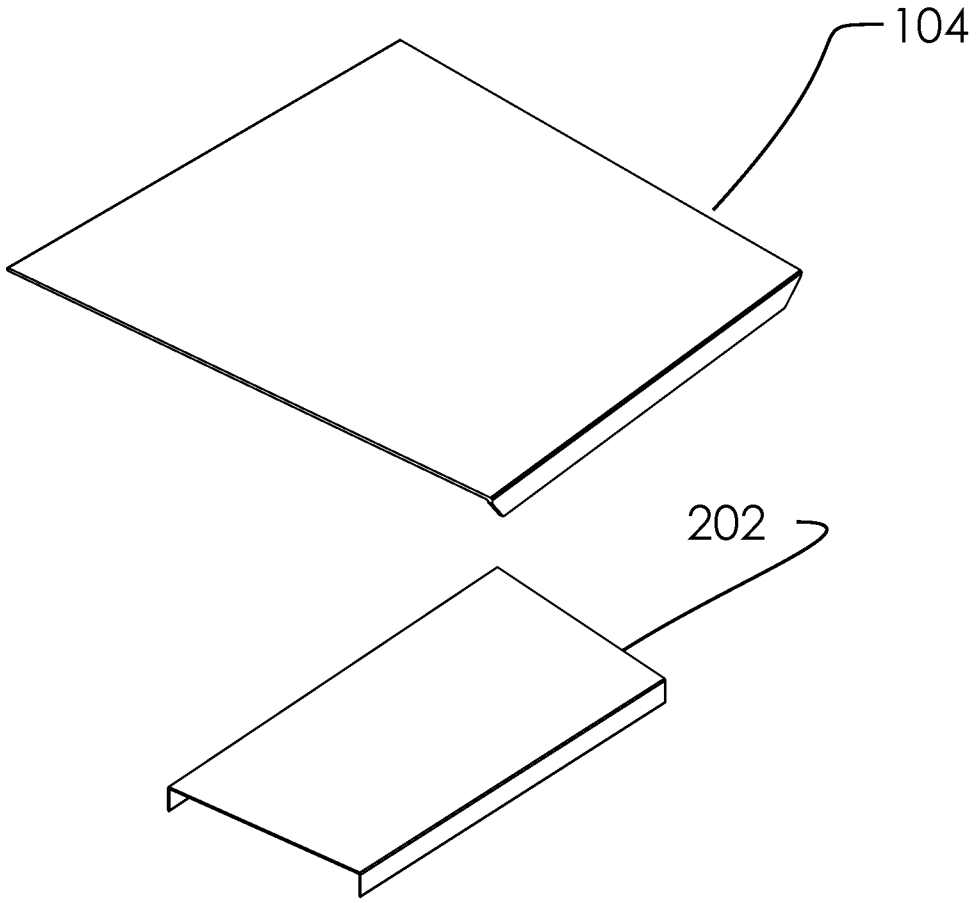
FIG. 12 illustrates elevated overview of a main control plate 104 and said intermediate fin plate 202.

FIG. 12 illustrates elevated overview of a main control plate 104 and said intermediate fin plate 202.

Figure 13:
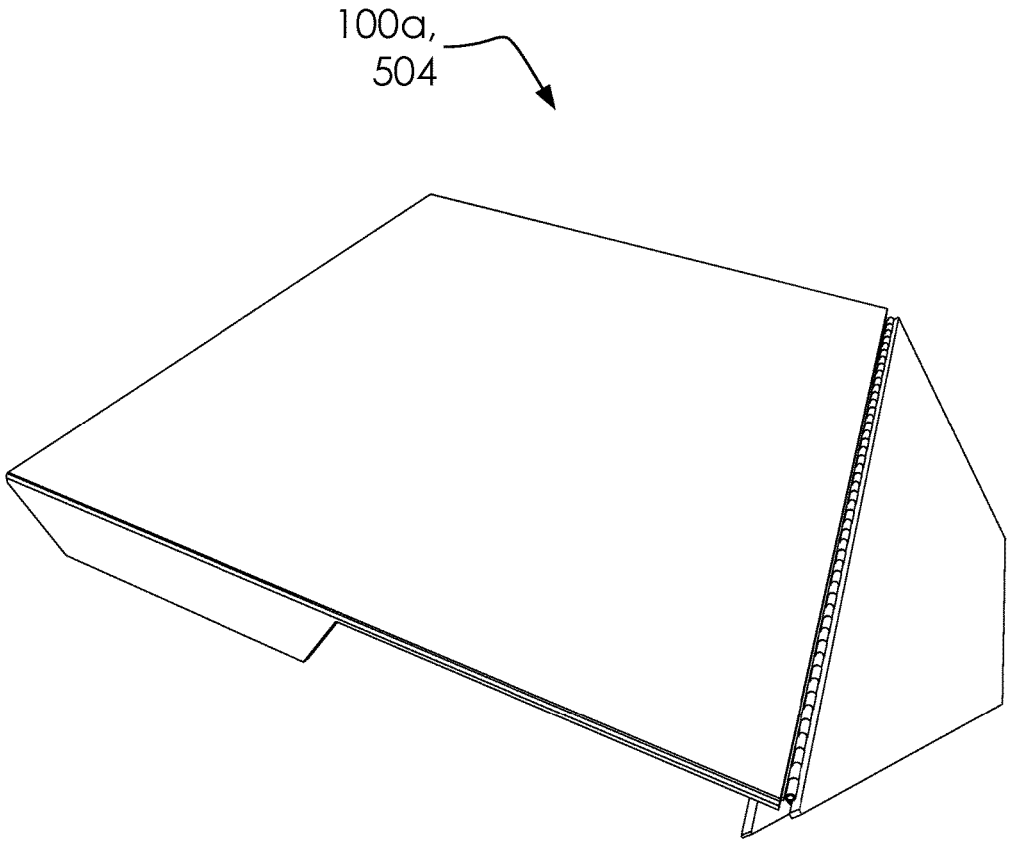
FIG. 13 illustrates perspective overview of a starboard surf tab 100*a* in an engaged position 504.

FIG. 13 illustrates perspective overview of a starboard surf tab 100*a* in an engaged position 504.

Figure 14:
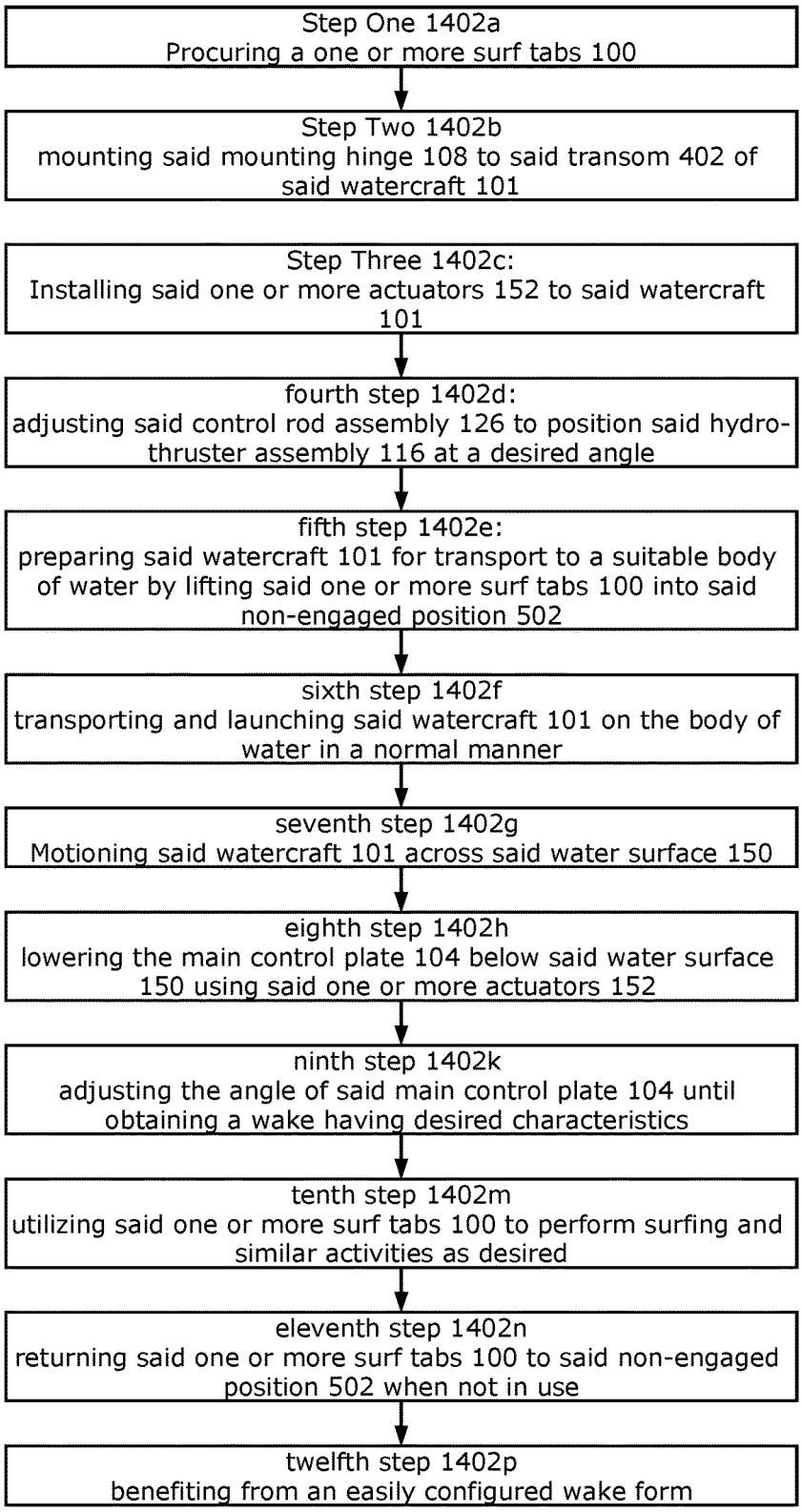
FIG. 14 illustrates diagram view of a flow chart 1400.

FIG. 14 illustrates diagram view of a flow chart 1400.

In one embodiment, said flow chart 1400 can comprise a first step 1402*a*, a second step 1402*b*, a third step 1402*c*, a fourth step 1402*d*, a fifth step 1402*e*, a sixth step 1402*f*, a seventh step 1402*g*, an eighth step 1402*h*, a ninth step 1402*k*, a tenth step 1402*m*, an eleventh step 1402*n*, and a twelfth step 1402*p*. The method of utilizing the one or more surf tabs 100 may be achieved by performing the steps of said flow chart 1400.

Said first step 1402*a* can comprise procuring a one or more surf tabs 100; said second step 1402*b* can comprise mounting the mounting hinge 108 to the transom 402 of a watercraft 101; said third step 1402*c* can comprise installing the one or more actuators 152 and associated control equipment into the watercraft 101; said fourth step 1402*d* can comprise adjusting the control rod assembly 126 to position the hydro-thruster assembly 116 at a desired angle; said fifth step 1402*e* can comprise preparing the watercraft 101 for transport to a suitable body of water by lifting the one or more surf tabs 100 to its maximum upper stowing position; said sixth step 1402*f* can comprise transporting and launching the watercraft 101 at the body of water in a normal manner; said seventh step 1402*g* can comprise motioning the watercraft 101 across the water surface 150; said eighth step 1402*h* can comprise lowering the main control plate 104 below the water surface 150 using the one or more actuators 152; said ninth step 1402*k* can comprise adjusting the angle of the main control plate 104 until obtaining a wake having desired characteristics; said tenth step 1402*m* can comprise utilizing the one or more surf tabs 100 to perform surfing and similar water sports activities as desired; said eleventh step 1402*n* can comprise returning the one or more surf tabs 100 to its uppermost stowing position when not in use; and, said twelfth step 1402*p* can comprise benefiting from an easily configured wake form, afforded a user of said one or more surf tabs 100. In one embodiment, said port surf tab 100*b* can be added and used in a similar manner.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A wake-shaping system, comprising:

a one or more surf tabs attached to a watercraft;

each among said one or more surf tabs comprise a control plate assembly, a mounting hinge, and a hydro-thruster assembly;

further, each among said one or more surf tabs comprise a leading edge, a trailing edge, an interior side, an exterior side, a top side and a bottom side;

said control plate assembly is rotateably attached to a portion of said watercraft with said mounting hinge;

said hydro-thruster assembly comprises an upper hydro-thruster plate, a side hydro-thruster plate, a lower hydro-thruster plate, and a one or more diversion fins;

said side hydro-thruster plate connects said upper hydro-thruster plate to said lower hydro-thruster plate;

said one or more diversion fins are between said upper hydro-thruster plate and said lower hydro-thruster plate;

said side hydro-thruster plate is at said interior side of said one or more surf tabs;

said hydro-thruster assembly is attached at said trailing edge of said one or more surf tabs;

each of said one or more surf tabs are operable to receive a water at said leading edge, divert a portion of said water into said hydro-thruster assembly, through said one or more diversion fins and between said upper hydro-thruster plate, said side hydro-thruster plate and said lower hydro-thruster plate, and expel a portion of said water out of said hydro-thruster assembly at said trailing edge of said one or more surf tabs; and said mounting hinge is operable to rotateably adjust an angle of said one or more surf tabs relative to said watercraft.

2. The wake-shaping system of claim 1, wherein, said hydro-thruster assembly comprises a wedge shape;

said hydro-thruster assembly comprises a first side with a first height, and a second side with a second height;

said side hydro-thruster plate is located at said second side; and said first height is smaller than said second height.

3. The wake-shaping system of claim 1, wherein, said mounting hinge comprises a piano-type hinge.

4. The wake-shaping system of claim 1, wherein, each of said one or more surf tabs further comprise a separation hinge between said control plate assembly and said hydro-thruster assembly; and said control plate assembly adjustably rotates relative to said hydro-thruster assembly with said separation hinge.

5. The wake-shaping system of claim 4, wherein, each of said one or more surf tabs further comprise a control rod assembly, a one or more mounting brackets and a hydro-thruster angle;

said hydro-thruster angle can comprise an angle between said control plate assembly and said hydro-thruster assembly;

said hydro-thruster angle is adjustable by adjusting said control rod assembly;

said one or more mounting brackets comprise a first mounting bracket and a second mounting bracket;

said first mounting bracket is mounted to said control plate assembly;

said second mounting bracket is mounted to said hydro-thruster assembly;

said control rod assembly comprises a first end, a second end and a control rod;

said first end rotateably attaches to said first mounting bracket;

said second end rotateably attaches to said second mounting bracket; and said control rod comprise a variable length operable to adjust a distance between said first mounting bracket and said second mounting bracket and thereby adjusting said hydro-thruster angle.

6. The wake-shaping system of claim 5, wherein, said control rod comprise an adjustable turnbuckle-style rod.

7. The wake-shaping system of claim 1, wherein, each of said one or more surf tabs further comprise a one or more actuators;

said mounting bracket is attached to said top side of said one or more surf tabs; and said one or more actuators attach to said one or more surf tabs at said mounting bracket at a first end and to a portion of said watercraft at a second end.

8. The wake-shaping system of claim 7, wherein, said one or more actuators are electric linear actuators; and said one or more actuators are operable to be electrically controlled to raise and lower said one or more surf tabs on said mounting hinge.

9. The wake-shaping system of claim 1, wherein, said control plate assembly comprises a one or more separation fins at said interior side and said exterior side.

10. The wake-shaping system of claim 9, wherein, said one or more separation fins comprise a first separation fin and a second separation fin;

said first separation fin is located at said interior side; and said second separation fin is located at said exterior side.

11. The wake-shaping system of claim 10, wherein, said control plate assembly comprises a main control plate; and said one or more separation fins comprise portions of said main control plate turned downward.

12. The wake-shaping system of claim 10, wherein, said control plate assembly comprises a main control plate; and said one or more separation fins comprise plates welded to portions of said main control plate.

13. The wake-shaping system of claim 10, wherein, said second separation fin is isolated in a portion of said control plate assembly corresponding to said leading edge.

14. The wake-shaping system of claim 9, wherein, said one or more separation fins are parallel with one another.

15. The wake-shaping system of claim 1, wherein, said control plate assembly comprises a main control plate and an intermediate fin plate;

said intermediate fin plate is attached to a lower surface of said main control plate; and said intermediate fin plate comprises a one or more setup fins.

16. The wake-shaping system of claim 15, wherein, said one or more setup fins comprise a first setup fin and a second setup fin;

said first setup fin is arranged proximate to said interior side, and said second setup fin is arranged proximate to said exterior side; and said first setup fin is longer than said second setup fin.

17. The wake-shaping system of claim 15, wherein, said one or more setup fins of said intermediate fin plate are operable to direct water into said hydro-thruster assembly.

18. The wake-shaping system of claim 1, wherein, portions of said one or more surf tabs comprise welded aluminum.

19. The wake-shaping system of claim 1, wherein, said one or more diversion fins comprise at least a first diversion fin and a second diversion fin arranged between said side hydro-thruster plate at a second side of said hydro-thruster assembly and a first side of said hydro-thruster assembly;

said one or more diversion fins are operable to direct water toward said trailing edge and outward toward said exterior side of said watercraft;

said one or more diversion fins are arranged with a leading fin edge being proximate to said second side of said hydro-thruster assembly and a trailing fin edge proximate to said first side of said hydro-thruster assembly; and therefore said one or more diversion fins are operable to direct fluid rearward and outward relative to a forward motion of said watercraft and said one or more surf tabs.

20. The wake-shaping system of claim 1, wherein, said one or more surf tabs comprise a starboard surf tab and a port surf tab;

said starboard surf tab is attached proximate to a starboard portion of said watercraft; and said port surf tab is attached proximate to a port portion of said watercraft.

21. A method of using a wake-shaping system comprising:

procuring a one or more surf tabs each having
a mounting hinge,
a one or more actuators,
a control plate assembly,
a hydro-thruster assembly and
a main control plate;

mounting said mounting hinge of said one or more surf tabs to a transom of a watercraft;

installing said one or more actuators and associated said one or more actuators with a control equipment of said watercraft;

adjusting a control rod assembly to position said hydro-thruster as desired;

transporting and launching said watercraft at a body of water;

motioning said watercraft across said water surface;

lowering said main control plate below a water surface using said one or more actuators;

adjusting a hydro-thruster angle, between said main control plate and said hydro-thruster assembly, until obtaining a wake having desired characteristics;

utilizing said one or more surf tabs to perform water sports activities as desired; wherein, further, each among said one or more surf tabs comprise a leading edge, a trailing edge, an interior side, an exterior side, a top side and a bottom side;

said control plate assembly is rotateably attached to a portion of said watercraft with said mounting hinge;

said hydro-thruster assembly comprises an upper hydro-thruster plate, a side hydro-thruster plate, a lower hydro-thruster plate, a one or more diversion fins;

said side hydro-thruster plate connects said upper hydro-thruster plate to said lower hydro-thruster plate;

said one or more diversion fins are between said upper hydro-thruster plate and said lower hydro-thruster plate;

said side hydro-thruster plate is at said interior side of said one or more surf tabs;

said hydro-thruster assembly is attached at said trailing edge of said one or more surf tabs;

each of said one or more surf tabs are operable to receive a water at said leading edge, divert a portion of said water into said hydro-thruster assembly, through said one or more diversion fins and between said upper hydro-thruster plate, said side hydro-thruster plate and said lower hydro-thruster plate, and expel a portion of said water out of said hydro-thruster assembly at said trailing edge of said one or more surf tabs; and said mounting hinge is operable to rotateably adjust an angle of said one or more surf tabs relative to said watercraft.

* * * * *